US006415760B2

(12) United States Patent
Mack et al.

(10) Patent No.: US 6,415,760 B2
(45) **Date of Patent: *Jul. 9, 2002**

(54) INTERNAL COMBUSTION ENGINE

(75) Inventors: Eberhard Mack, Notzingen; Hamdi Saydam, Sindelfingen, both of (DE)

(73) Assignee: DaimlerChrysler AG, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/320,325

(22) Filed: May 26, 1999

(30) Foreign Application Priority Data

May 26, 1998 (DE) ..... 198 23 254

(51) Int. Cl.[7] ..... F01P 11/08

(52) U.S. Cl. ..... 123/196 R

(58) Field of Search ..... 123/196 AB, 41.33, 123/142.5 E, 142.5 R

(56) References Cited

U.S. PATENT DOCUMENTS

| | | | | | |
|---|---|---|---|---|---|
| 1,916,237 | A | * | 7/1933 | Sloan | 123/142.5 E |
| 1,999,003 | A | * | 4/1935 | Bushnell | 123/142.5 E |
| 3,134,374 | A | | 5/1964 | Stevens | 123/142.5 R |
| 3,979,574 | A | * | 9/1976 | Rynard | 123/142.5 E |
| 4,770,134 | A | * | 9/1988 | Foreman et al. | 123/142.5 R |
| 5,758,608 | A | * | 6/1998 | Berger et al. | 123/41.33 |

FOREIGN PATENT DOCUMENTS

| | | | | |
|---|---|---|---|---|
| DE | 1 802 794 | * | 6/1970 | |
| DE | 29 05 571 | | 8/1980 | |
| DE | 3737390 A1 | * | 5/1989 | 184/6.22 |
| DE | 196 00 566 | * | 4/1997 | |

* cited by examiner

*Primary Examiner*—Marguerite McMahon
*Assistant Examiner*—Hyder Ali
(74) *Attorney, Agent, or Firm*—Kenyon & Kenyon

(57) ABSTRACT

An internal combustion engine has an oil cooler arranged in a water tank of a cylinder crankcase, with cooling water from a cooling water circuit flowing through the water tank. To improve the cold start properties of an internal combustion engine, without increasing the installation space, while also permitting subsequent retrofitting, an electric heating element is arranged in the water tank.

16 Claims, 4 Drawing Sheets

INTERNAL COMBUSTION ENGINE

FIELD OF THE INVENTION

The present invention relates to an internal combustion engine.

BACKGROUND INFORMATION

German Patent No. 196 00 566 Cl discloses a multicylinder internal combustion engine whose cylinder crankcase is provided with an oil cooler for lubricating oil. The oil cooler is located in an integrally cast water tank on the side of the cylinder crankcase with cooling water from a cooling water circuit flowing through it. The cooling water flows around the oil cooler and is then sent into the cylinder head where it flows along the outside of the cylinder as a cooling water jacket.

A disadvantage of this design is that the lubricating oil has a high viscosity because of the low temperatures when the internal combustion engine is cold, e.g., in startup after a relatively long standstill, and because of its reduced flow capacity it is not capable of adequately lubricating the moving parts of the internal combustion engine, in particular the bearing points of the crankshaft and the connecting rod.

Another problem with a cold engine is that fuel condenses on the cylinder walls, so the fuel/air ratio in the combustion chamber deviates from the optimum, and the pollutant concentration in the exhaust is increased.

To avoid this problem, German Patent Application No. 29 05 571 proposes that the cooling water be preheated with the help of an electric heating element, so that heated cooling water flows around the cylinders and preheats them. This measure should make the engine much easier to start and should also prevent frost damage. However, the problem that arises here is integrating the heating element into the cylinder crankcase in such a way as to achieve a compact design of the device while also yielding the possibility of retrofitting with little outlay older internal combustion engines whose cylinder crankcase is not prepared to accommodate a heating element and nevertheless being a device with a small design.

SUMMARY OF THE INVENTION

An object of the present invention is to improve upon the cold start properties of an internal combustion engine, where the required measures should be feasible without increasing the size of the installation space and subsequent retrofitting should be possible.

The present invention provides an internal combustion engine with an oil cooler arranged in a water tank of a cylinder crankcase, with cooling water from a cooling-water circuit flowing through the water tank. The present invention is characterized in that an electric heating element is provided which is arranged in the water tank.

The electric heating element can also be installed in the water tank subsequently without requiring extensive conversion measures, and the crankcase in particular need not be altered. This yields a fully integrated cooling water heating system which can be operated to preheat the engine even before starting and greatly improves the startup properties and contributes to pollution reduction. The cooling water heating system requires practically no additional installation space and can be installed easily and directly even later at the customer's, thereby lowering installation costs. Maintenance work can also be performed quickly. Costs are reduced on the whole, because the crankcase need not be converted.

Another advantage is that the lubricating oil is also heated due to the position of the oil cooler directly on the heating element or in the water tank which is flooded with cooling water that has been heated, so this improves the flow properties. The lubricating oil flows more readily to the bearing points, thus yielding better lubrication of moving parts. The heated oil cooler in turn influences the cooling water, because the cooling water is heated more quickly due to the increased radiant heat surface of the oil cooler, so the cylinders are also preheated in a shorter period of time.

The heating element and the oil cooler preferably form a composite element by having the heating element mounted directly on the oil cooler, in particular by soldering onto the bottom of the oil cooler. This yields a cohesive component of heating element and oil cooler in a space-saving design that can be prefabricated in particular and installed in the water tank and can be removed from the water tank for maintenance work.

According to a preferred embodiment, the heating element is designed as a heating coil, so the heat radiating surface area of the heating element is increased and the heating process is carried out in a shorter period of time.

The heating element is advantageously located completely inside the lateral border of the bottom of the oil cooler, so the dimensions of the water tank can remain essentially the same and in particular the installed height of the cylinder block remains the same; this yields an especially space-saving design.

BRIEF DESCRIPTION OF THE DRAWINGS

Additional advantages and expedient embodiments can be derived from the additional claims, the description of the figures and the drawings, which show:

DETAILED DESCRIPTION

Figure 1:
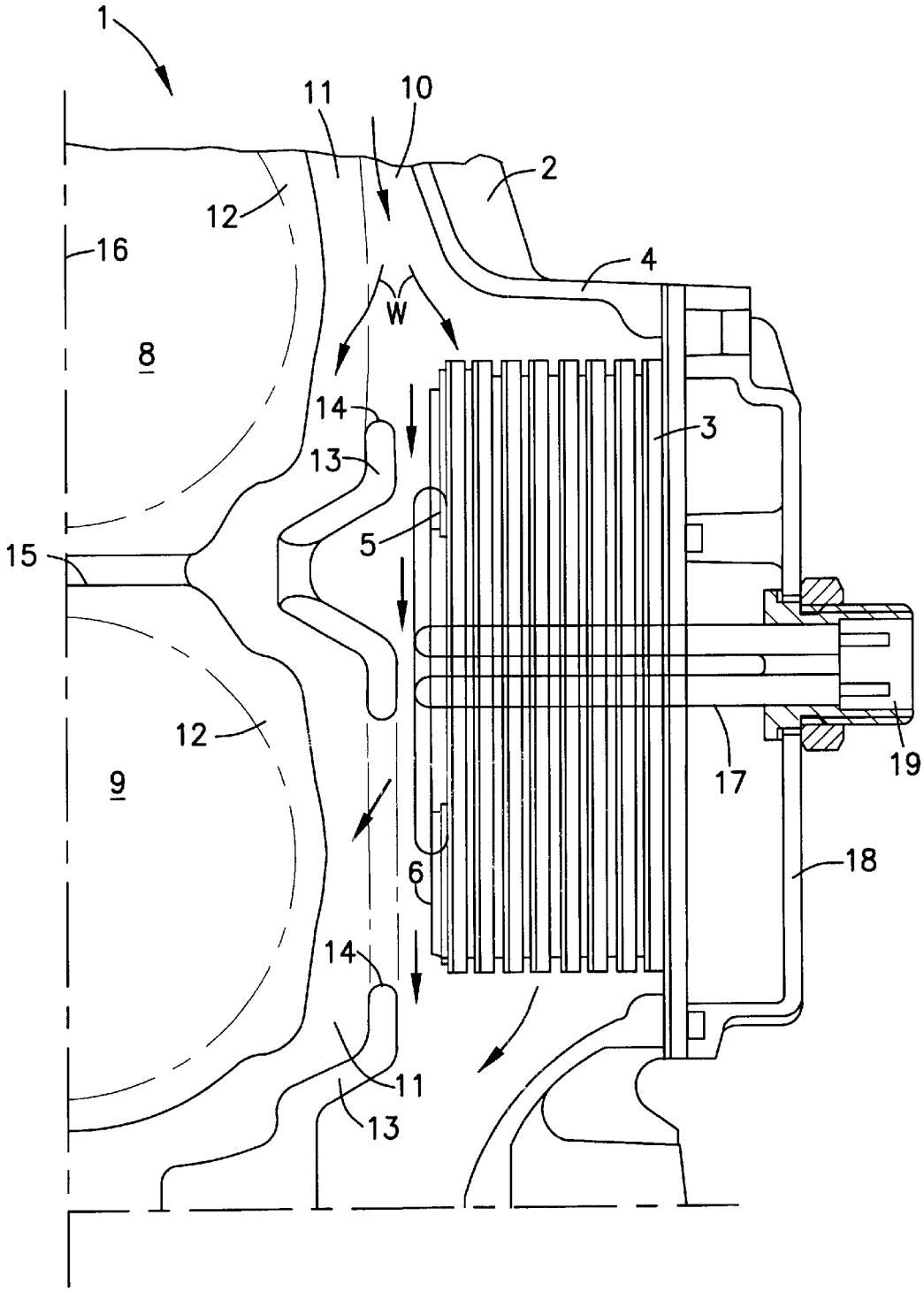
FIG. 1 shows a top view of an oil cooler with a heating element.

FIG. 1 shows part of a cylinder crankcase 2 of an internal combustion engine 1 with cylinders 8, 9. The cylinder crankcase 2 has an integrally cast water tank 4 on the side of the cylinder crankcase, with an oil cooler 3 for lubricating oil arranged in the water tank. The interior of water tank 4 is in the flow path of a cooling water circuit which serves generally to cool the internal combustion engine. The cooling water W passes through an inlet opening 10 in cylinder crankcase 2 into water tank 4 in the direction of the arrow indicated and flows around oil cooler 3. Upstream from water tank 4, during the flow through the water tank and downstream from the water tank through openings 14 in a jacket wall 13, some of cooling water W is sent to a cooling water jacket 11 passing vertically downward between cylinder walls 12 and jacket wall 13, removing the heat generated in cylinders 8, 9. At the same time, jacket wall 13 forms a bordering wall for water tank 4. Channels 15 are created between cylinder walls 12, so that cooling water can flow through them, thus cooling cylinders 8, 9 on all sides. Channels 15 run across longitudinal axis 16 of cylinder crankcase 2. Cooling water jacket 11 extends essentially parallel to longitudinal axis 16.

A heating element 5 is arranged in water tank 4 to preheat the cooling water when the internal combustion engine is cold. Heating element 5 is located between jacket wall 13 and oil cooler 3 and is mounted by soldering in particular onto bottom 6 of oil cooler 3 which faces cylinders 8, 9. Oil cooler 3 and heating element 5 form a cohesive component and can be installed together in the water tank and removed together from the water tank.

Heating element 5 can be heated electrically. Power is supplied by a current lead 17 passing along the side of oil cooler 3 to a cover 18 of water tank 4 and leading to a plug connector 19 on the outside of cover 18.

Figure 2:
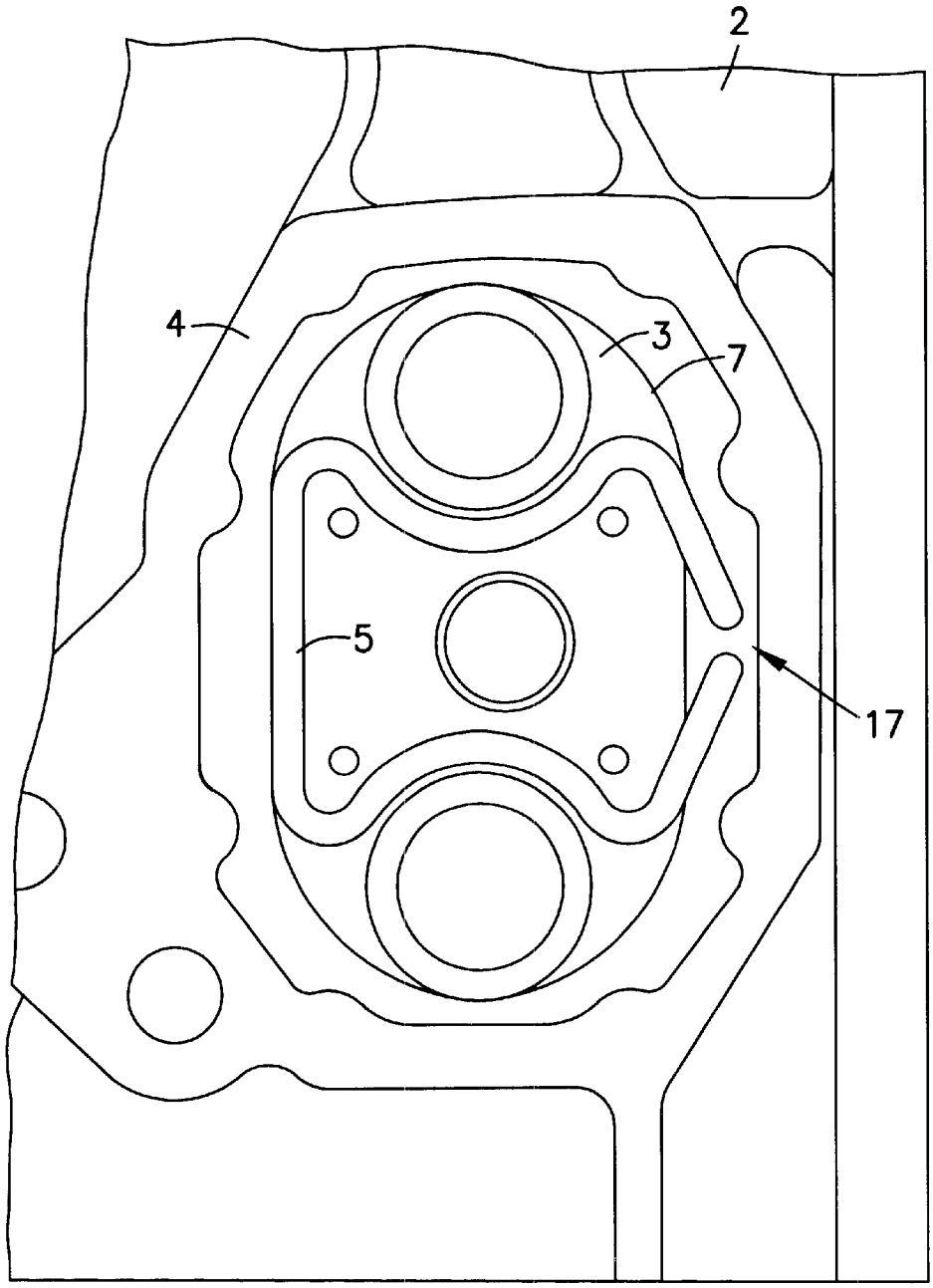
FIG. 2 shows a view of the heating element from FIG. 1.

FIG. 2 shows that heating element 5 in water tank 4 of cylinder crankcase 2 is designed as a heating coil wound in a coil pattern on the bottom 6 of oil cooler 3. A space-saving arrangement is achieved by the fact that heating element 5 runs essentially inside border 7 of bottom 6, so the dimensions of the overall arrangement comprising oil cooler 3 and heating element 5 are determined essentially by only the size of the oil cooler. Only the ends of the heating coil go beyond border 7 to create the possibility of a contact with current lead 17 passing along the side of oil cooler 3.

Figure 3:
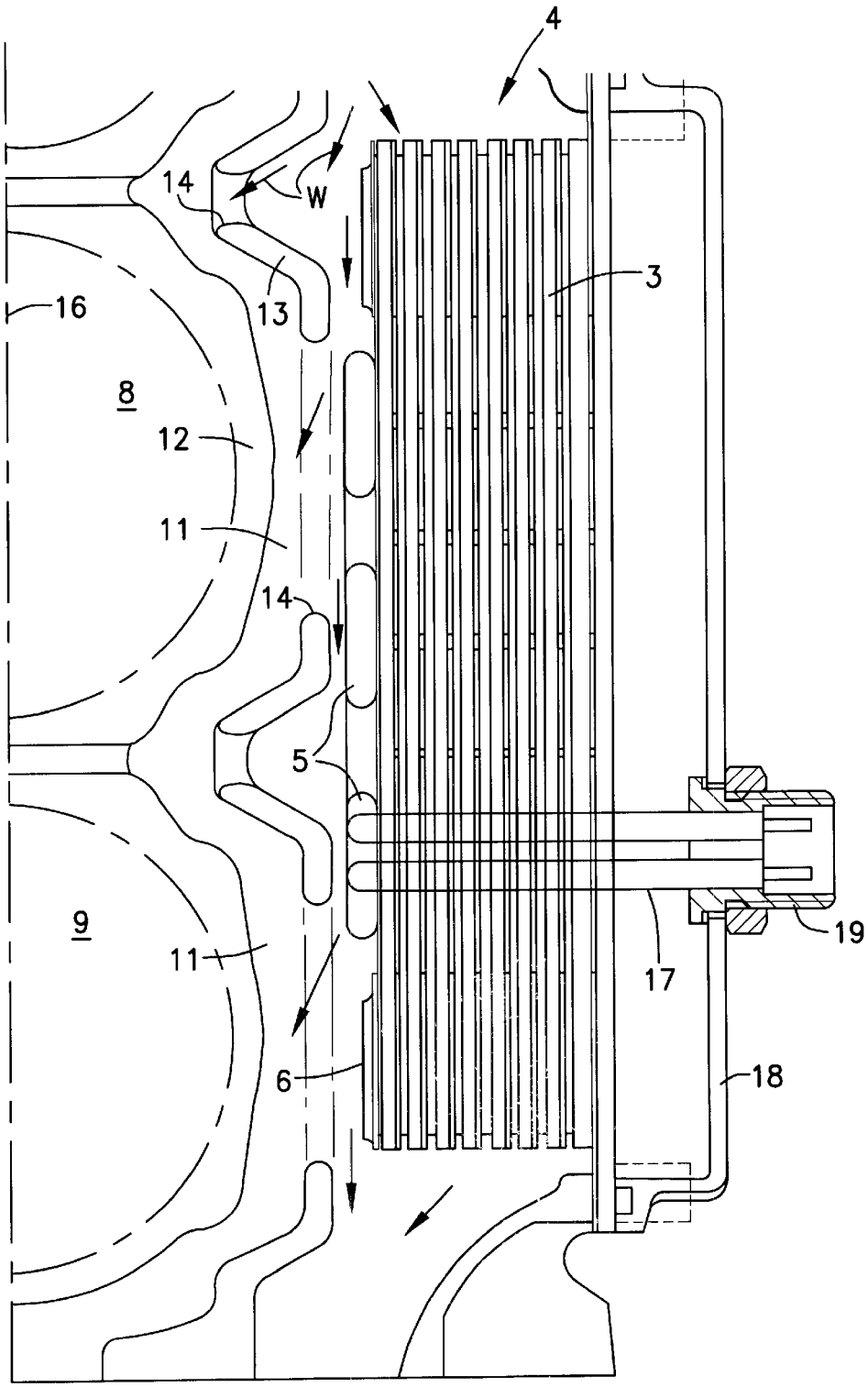
FIG. 3 shows a top view of an oil cooler with heating elements in another embodiment.
Figure 4:
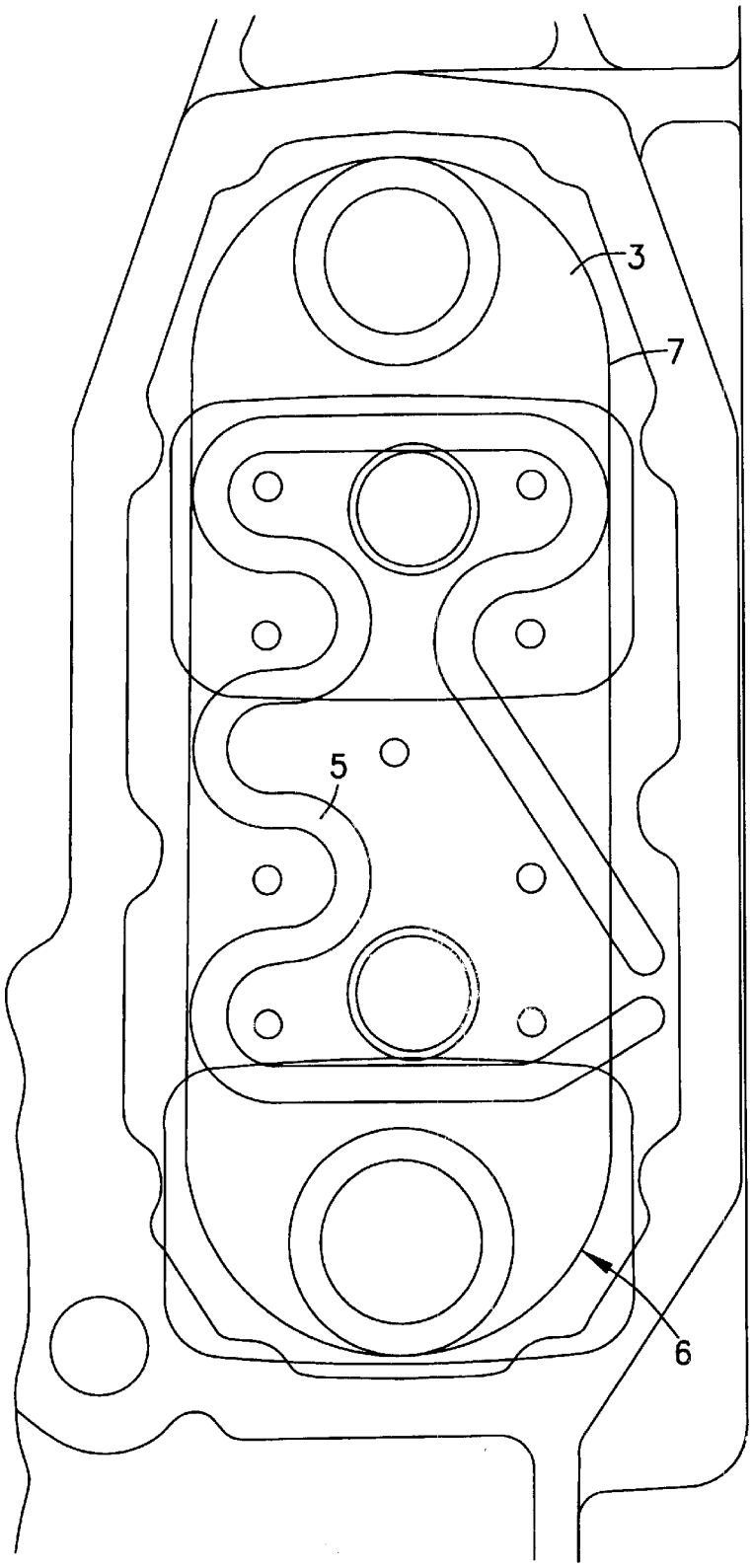
FIG. 4 shows a view of the heating element from FIG. 3.

FIGS. 3 and 4 show another embodiment, where parts identical to those in the first embodiment are labeled with the same reference numbers.

According to FIG. 3, cooling water W flows through water tank 4 with oil cooler 3, which is designed to be longer than the oil cooler in the first embodiment, approximately parallel to longitudinal axis 16 of the cylinder crankcase. Some of the cooling water branches out from water tank 4 and goes through openings 14 in jacket wall 13 into a cooling water jacket 11 between jacket wall 13 and cylinder walls 12 of cylinders 8, 9.

Electric heating element 5 is mounted on bottom 6 of oil cooler 3, between oil cooler 3 and jacket wall 13, and receives power over current lead 17 and plug connector 19 in cover 18.

As shown in FIG. 4 in particular, heating element 5 is designed as a heating coil with multiple coils arranged inside border 7 of bottom 6 of oil cooler 3. Due to the larger number of turns, the heating element has a larger surface area, so that more heat is radiated.

What is claimed is:

1. An internal combustion engine comprising:

a cylinder crankcase having a water tank, cooling water from a cooling-water circuit flowing through the water tank;

an oil cooler arranged in the water tank; and an electric heating element arranged in the water tank and adjacent the oil cooler.

2. An internal combustion engine, comprising:

a cylinder crankcase having a water tank, cooling water from a cooling-water circuit flowing through the water tank;

an oil cooler arranged in the water tank; and an electric heating element arranged in the water tank;

wherein the heating element is mounted on a bottom of the oil cooler.

3. The internal combustion engine as recited in claim 2 wherein the heating element is soldered onto a bottom of the oil cooler.

4. The internal combustion engine as recited in claim 2 wherein the heating element is inside a side border of the bottom of the oil cooler.

5. An internal combustion engine, comprising:

a cylinder crankcase having a water tank, cooling water from a cooling-water circuit flowing through the water tank;

an oil cooler arranged in the water tank; and an electric heating element arranged in the water tank;

wherein the heating element is a coil.

6. The internal combustion engine as recited in claim 1 wherein a current lead of the heating element is guided to a cover of the water tank.

7. A method of controlling an internal combustion engine having a cylinder crankcase comprising the steps of:

passing cooling water through a water tank of the cylinder crankcase;

cooling oil in an oil cooler arranged in the water tank; and heating the oil using an electric heating element arranged in the water tank adjacent the oil cooler.

8. The method as recited in claim 7 wherein the heating step occurs before a starting of the internal combustion engine.

9. The internal combustion engine as recited in claim 1 wherein the water tank is integral to the cylinder crankcase.

10. The method as recited in claim 7 wherein the water tank is integral to the cylinder crankcase.

11. An internal combustion engine comprising:

a cylinder crankcase having a water tank, cooling water from a cooling-water circuit flowing through the water tank;

an oil cooler arranged in the water tank; and an electric heating element arranged in the water tank.

12. The internal combustion engine as recited in claim 11 wherein a current lead of the heating element is guided to a cover of the water tank.

13. The internal combustion engine as recited in claim 11 wherein the water tank is integral to the cylinder crankcase.

14. A method of controlling an internal combustion engine having a cylinder crankcase comprising the steps of:

passing cooling water through a water tank of the cylinder crankcase;

cooling oil in an oil cooler arranged in the water tank; and heating the cooling water using an electric heating element arranged in the water tank.

15. The method as recited in claim 14 wherein the heating step occurs before a starting of the internal combustion engine.

16. The method as recited in claim 14 wherein the water tank is integral to the cylinder crankcase.

* * * * *